US006360758B1

(12) United States Patent
Eivola et al.

(10) Patent No.: US 6,360,758 B1
(45) Date of Patent: Mar. 26, 2002

(54) CLEANING DEVICE IN PAPER MACHINES, BOARD MACHINES OR OTHER SIMILAR MACHINES FOR CLEANING A FABRIC, SUCH AS WIRE OR FELT

(75) Inventors: Ilkka Eivola, Naantali (FI); Markku Lemetyinen, Clifton Park, NY (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/393,293

(22) Filed: Sep. 10, 1999

(51) Int. Cl.[7] ..... B08B 3/02

(52) U.S. Cl. ..... 134/122 R; 134/109.1; 134/198; 134/181; 134/172; 162/275; 198/495

(58) Field of Search ..... 239/227, 264; 162/275, 276; 198/495; 134/64 R, 122 R, 104.1, 198, 181, 172

(56) References Cited

U.S. PATENT DOCUMENTS

| | | | | |
|---|---|---|---|---|
| 3,966,544 A | * | 6/1976 | Johnson | |
| 4,073,376 A | * | 2/1978 | Krooss | |
| 4,777,972 A | * | 10/1988 | Adam | |
| 5,706,932 A | * | 1/1998 | White | |
| 5,783,044 A | * | 7/1998 | Schneider et al. | 134/199 |
| 5,879,515 A | * | 3/1999 | Straub et al. | |
| 5,964,960 A | * | 10/1999 | Boeck | |
| 6,135,267 A | * | 1/2000 | Straub | |

FOREIGN PATENT DOCUMENTS

| | | | | |
|---|---|---|---|---|
| DE | G 92 08 909.7 | | 7/1992 | |
| GB | 312370 | * | 7/1930 | 162/275 |
| SU | 935404 | * | 6/1982 | 198/495 |
| SU | 988702 | * | 1/1983 | 198/495 |
| SU | 1207932 | * | 1/1986 | 198/495 |
| SU | 1705205 | * | 1/1992 | 198/495 |
| WO | WO 97/42373 | | 11/1997 | |

OTHER PUBLICATIONS

WO 81/02567 Sep. 1981 198/495*

* cited by examiner

*Primary Examiner*—Frankie L. Stinson
(74) *Attorney, Agent, or Firm*—Nixon & Vanderhye P.C.

(57) ABSTRACT

A cleaning device in a paper or board machine, for cleaning a fabric therein, the fabric moving in a direction of movement. The device comprises a nozzle which directs a water shower or jet against the fabric which is to be cleaned, the nozzle including a first turning point, and wherein there is a first plane of the water shower or jet issuing from the nozzle. A plurality of water conduits which transport water to the nozzle. And, the nozzle being mounted so that the position thereof may be changed by turning the nozzle back and forth around the first turning point in the first plane, so as to change the direction of the water shower or jet discharged from the nozzle and so that the water shower is moved in a first linear movement.

10 Claims, 3 Drawing Sheets

CLEANING DEVICE IN PAPER MACHINES, BOARD MACHINES OR OTHER SIMILAR MACHINES FOR CLEANING A FABRIC, SUCH AS WIRE OR FELT

The present invention relates to a cleaning device for cleaning a fabric, such as wire or felt used in paper machines, paperboard machines or similar, according to the preamble of the first claim presented below.

In paper machines, paperboard machines or similar the fabrics used to support the web, such as the wires of the wet end and the dry end and the felts of the press section, will absorb fiber material and impurities which gradually block the fabric and prevent the water from migrating through the fabric, if the fabric is not cleaned from time to time. Therefore cleaning devices are used for instance in the wire return loop in order to clean the wire as it passes over the wire guide roll or similar.

A typical cleaning device comprises a water nozzle having a water jet, with which the fabric is cleaned as the fabric passes over a roll supporting the fabric. The cleaning device is movably fastened to a supporting beam or similar extending over the web, whereby the cleaning device can be moved back and forth across the fabric, and the fabric can be cleaned over the whole width of the fabric. The water supply conduits for the nozzle can be arranged within the supporting beam.

It is difficult to access the knots of the fabric with a water jet which has a perpendicular direction toward the fabric. Therefore it has been proposed to rotate the nozzle, whereby the water can better penetrate the knots and remove the fibres and impurities located there.

The publication WO 97/42373 proposes to mount a motor in the cleaning device in order to rotate the nozzle. The publication U.S. Pat. No. 5,783,044 proposes a cleaning device comprising one or more rotating nozzle heads. The nozzle heads are rotated by spraying water from them in a tangential direction. Rotating nozzles provide a good cleaning result.

However, some disadvantages are connected with the use of a rotating nozzle. The effectuation of the rotational motion e.g. with the aid of a motor increases the weight of the cleaning device, its space requirements and its price. Further, a rotating nozzle requires a rotating connector for the water supply, which forms a separate maintenace object.

Therefore the object of the present invention is to provide a new improved cleaning device.

The object is particularly to provide a cleaning device where the movement of the water jet from the nozzle is obtained with simple means.

Then an object is also to provide a cleaning device which avoids the use of moving joints and motors.

In order to attain the above mentioned objects the cleaning device according to the invention is characterised in what is defined in the characterising clause of claim 1 presented below.

A typical cleaning device according to the invention comprises first tilting means which turn the nozzle back and forth around a first turning point in a first plane in the direction of the water jet from the nozzle, so that the water jet obtains a first linear motion. Further, the cleaning device preferably comprises second tilting means which turn the nozzle back and forth around a turning point in a second plane in the direction of the water jet from the nozzle, so that the water jet in addition obtains a second linear motion.

The nozzle of the cleaning device and the tilting means are preferably mounted in a mounting plate which is easy to fit in a desired place of the paper machine. Then the nozzle is preferably fastened so that it is journalled in an opening made in the mounting plate, for instance by a spherical surface valve, and so that the fastening forms a turning point for the nozzle mainly at the bearing, around which turning point the nozzle can freely turn as the tilting means turn the nozzle.

The first tilting means are advantageously arranged to turn the nozzle back and forth around a turning point so that the water jet discharged from the nozzle obtains a linear motion in the travelling direction of the fabric. Correspondingly, the second tilting means are advantageously arranged to turn the nozzle back and forth so that the water jet discharged from the nozzle obtains a linear motion which is perpendicular regarding the travelling direction of the fabric. When desired, it is, of course, possible to direct the water jets with the tilting means so that they obtain a motion in a direction which is different from the above mentioned directions.

Advantageously the cleaning device is arranged at such a distance from the fabric, and the nozzle is advantageously continuously tilted back and forth so, that the water jet discharged from the nozzle covers an area having a length of about 5 cm in the travelling direction of the fabric and a width of about 5 cm in the cross-direction of the fabric. Typically the nozzle is turned about 15°.

The first and/or the second tilting means are preferably cylinders, such as pneumatic cylinders, with which the upper part of the nozzle can be alternately pushed away from the cylinder and alternately pulled closer to the cylinder.

Advantageously the cleaning device can be fastened to a supporting beam arranged transversely above the fabric, along which beam the cleaning device can be moved in the cross-direction of the fabric. The apparatus related to the supply of water, compressed air and electricity can be mounted in the beam.

It is advantageous to locate in the cleaning device a collecting hood or similar for the used cleaning water, from which hood the water can be directed away from the system along water channels.

With a cleaning device according to the invention the water can be easily spread over a large area and the cleaning water jets can hit the fabric's surface at different angles, whereby the fabric and also its knots are well cleaned. With a device according to the invention the cleaning water jets can be directed toward the fabric's surface at different angles without rotating the nozzle and without any motor. Also, the cleaning device does not require moving joints for the water supply, as the water can be directed to the nozzle via a flexible water hose.

The invention is described in more detail below with reference to the enclosed Figures, in which FIG. 1 shows schematically, as seen from the side, a cleaning device according to the invention which is arranged obliquely above the roll supporting the wire;

Figure 1:
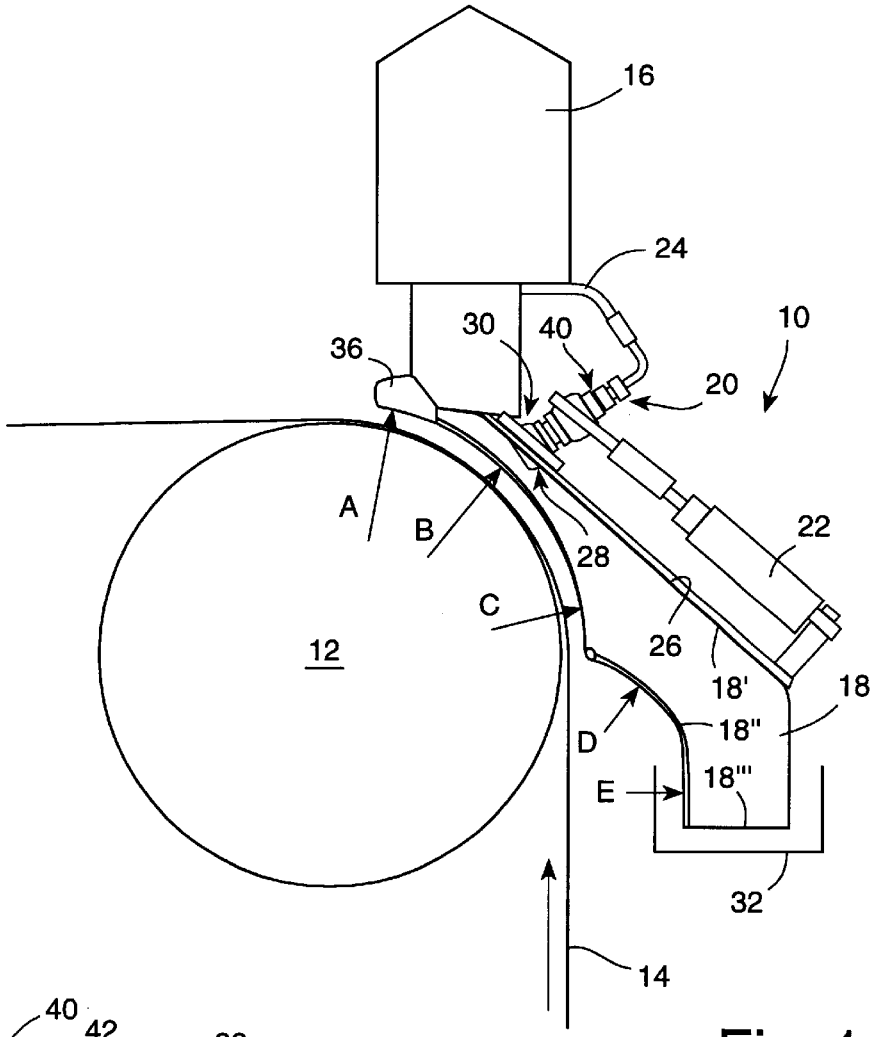

FIG. 1 shows a cleaning device 10 according to the invention when it is arranged above a wire 14 supported by a wire guide roll 12 and combined with a supporting beam 16 and a drainage hood 18. The cleaning device 10 comprises a nozzle 20 and two tilting cylinders 22, 24, of which the cylinder 22 is shown in FIG. 1. The nozzle 20 is connected via a flexible water hose 24 to the water supply means in the beam 12; the supply means are not shown in the Figure. The nozzle 20 and the tilting cylinders 22, 24 are fastened to a mounting plate 26 which is fastened to the upper wall 18' of the drainage hood 18. The lower part 30 of the nozzle 20 is arranged in the opening 28 located in the mounting plate 26, the lower part being that part where the actual nozzle orifice is located, as shown in more detail in FIG. 4.

At the upper part of the drainage hood 18 it is confined by the upper wall 18' and at its lower part it is confined by the lower wall 18", which, however, covers only a part of the lower part of the hood. The part of the drainage hood 18 toward the roll is open, so that it allows the water jet discharged from the nozzle 20 arranged above the hood to flow freely toward the fabric 14. The lowest bottom part 18'" of the drainage hood is also open, so that it allows the dirty water collected in the hood to flow out from the hood 18 into the water collecting channel 32. A compressed air nozzle 36 is arranged in the upper part 34 of the drainage hood.

Figure 3:
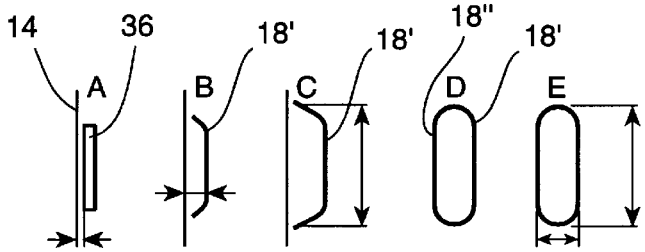
FIG. 3 shows cross-sections of the drainage hood of the FIG. 1 at different locations.

FIG. 3 shows cross-sections of the compressed air nozzle 36 and the drainage hood 18, at the locations A to E shown in FIG. 1. The FIG. 3 shows that the hood converges both in the width and the height directions, from the bottom to the top.

Figure 2:
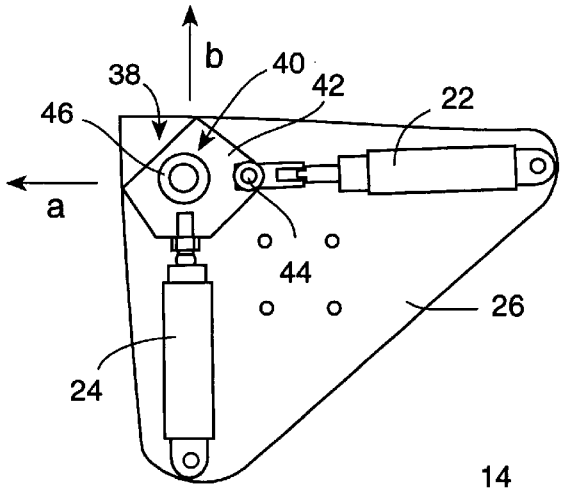
FIG. 2 shows the cleaning device shown in FIG. 1 as seen from above.

FIG. 2 shows the mounting plate 26 of FIG. 1 and the nozzle 20 and cylinders 22, 24 arranged in the plate. The cylinders are connected via the bearing 38 to the upper part 40 of the nozzle 20, as is best seen in FIG. 1. The tilting cylinder 22 turns the nozzle 20 in the travelling direction of the fabric, or in the direction shown by the arrow a in FIG. 2. The tilting cylinder 24 turns the nozzle 20 in the cross-direction of the fabric 14, or in the direction of the arrow b shown in FIG. 2.

Figure 4:
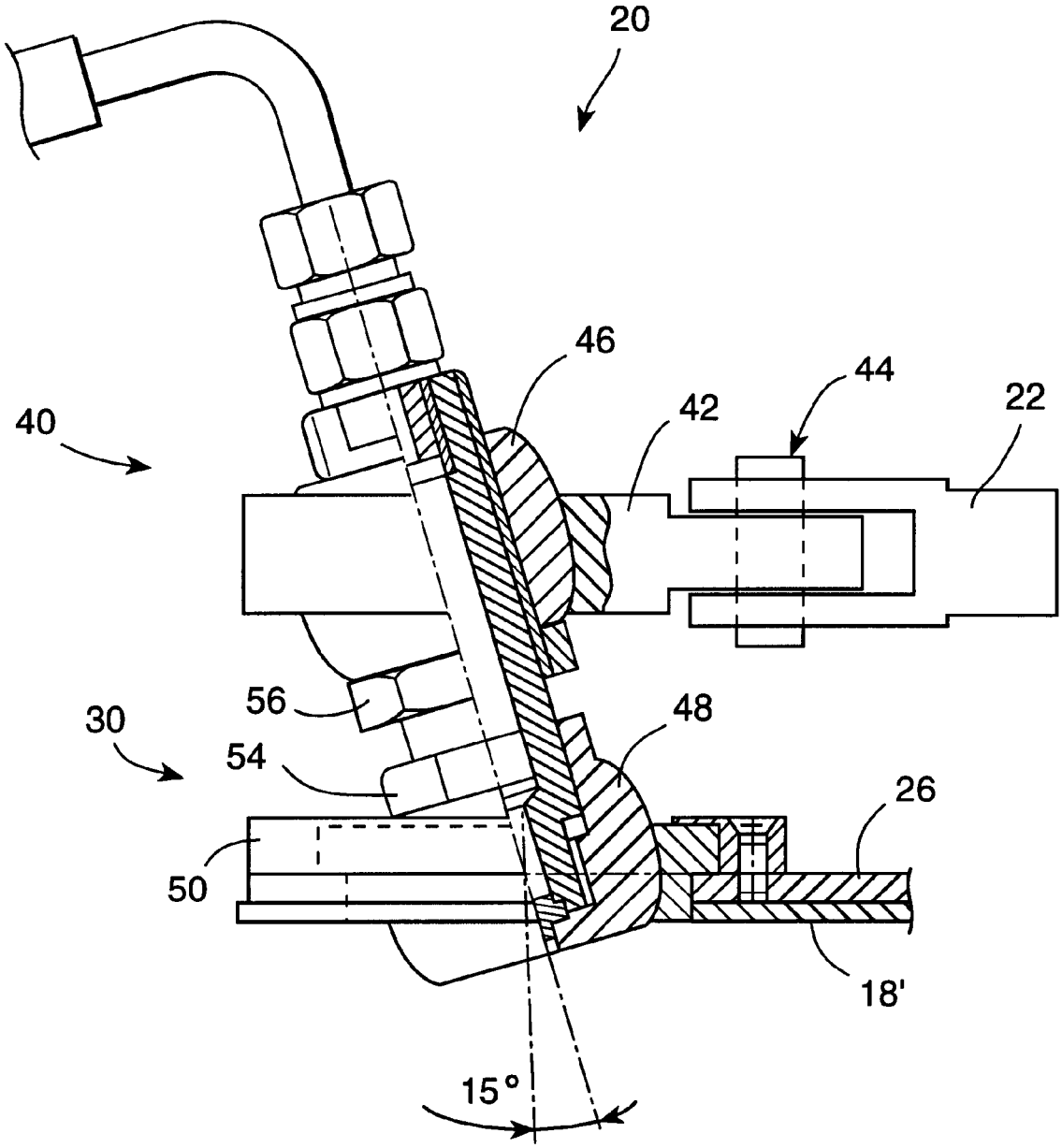
FIG. 4 shows an exemplary nozzle according to the invention seen from the side and partly cut away from the right side.

FIG. 4 shows in more detail the fastening of the nozzle 20 to the tilting cylinder 22 and to the mounting plate 26. The upper part 40 of the nozzle is connected via a bearing joint to the tilting cylinder 22. The bearing joint comprises a bearing housing 42 connected to the tilting cylinder via a rotating joint 44, and a ball surface bearing 46 arranged in the upper part 40 of the nozzle 20. The other tilting cylinder 24 (which is seen in FIG. 2) is connected in a corresponding way to the bearing housing 42. Due to the ball surface bearing the nozzle can be turned around the turning point in the lower part of the nozzle into different positions, whereby the nozzle can provide a water jet which is directed at desired angles toward the fabric or wire.

The lower part 30 of the nozzle is in a corresponding way connected via a ball surface bearing 48 with the bearing housing 50 arranged in the mounting plate 26, whereby the nozzle can be easily turned into different angles. During the cleaning operation the nozzle is advantageously turned about 15 degrees, as shown in FIG. 4.

Figure 5:
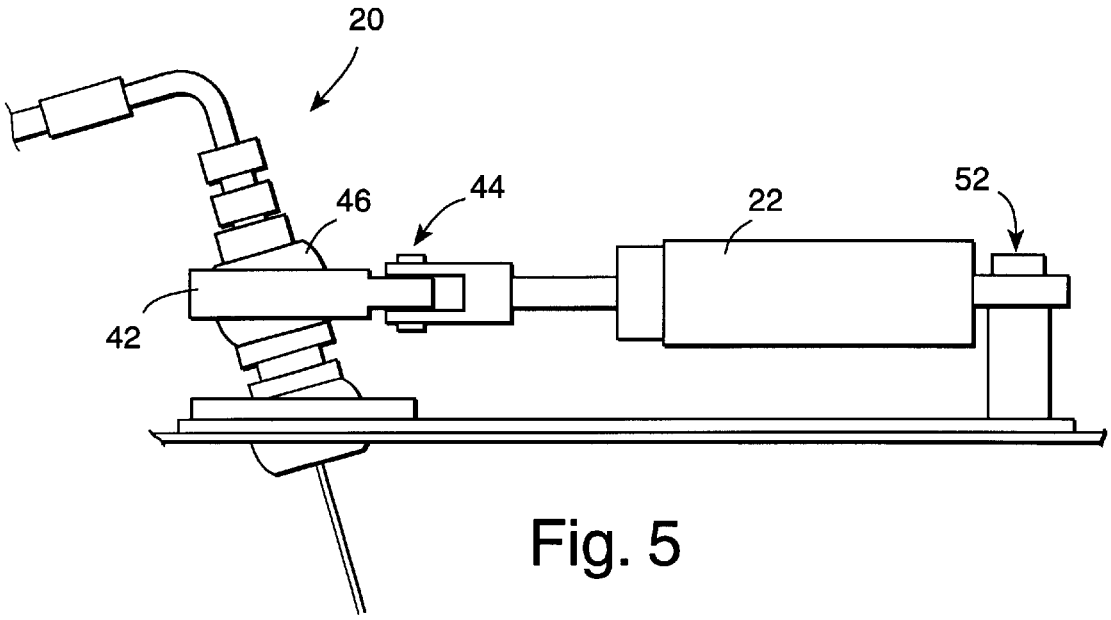
FIG. 5 shows schematically a cleaning device according to the invention seen from the side in a first extreme position.
Figure 6:
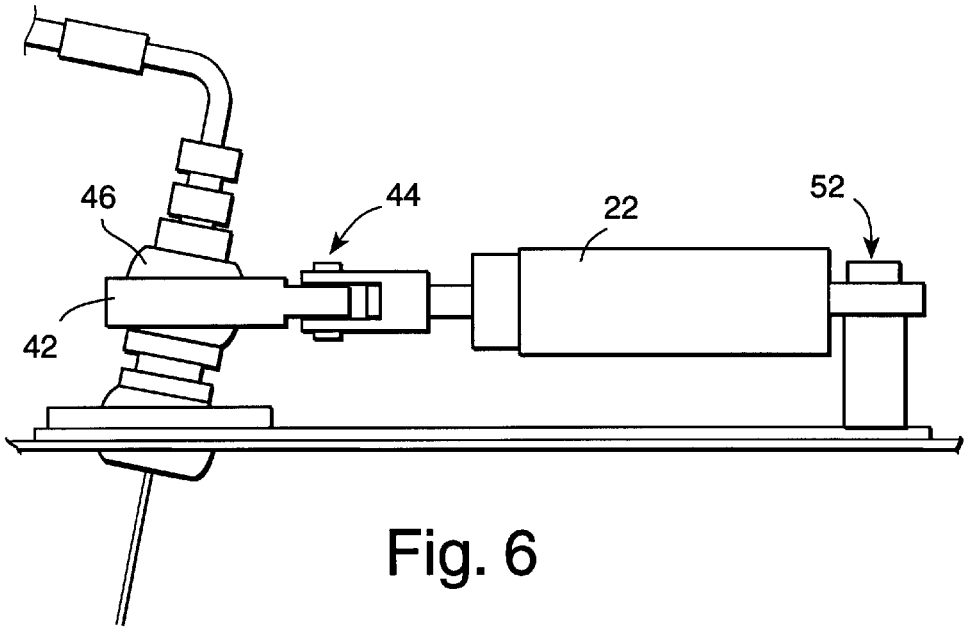
FIG. 6 shows the cleaning device of FIG. 5 in the other extreme position.

FIGS. 5 and 6 show a cleaning device according to the invention in its different extreme positions regarding the movement of the tilting cylinder 22. In FIG. 5 the tilting cylinder 22 has pushed the bearing housing 42 to the left extreme position. Then the ball surface bearing 46 has turned the nozzle 20 so that it directs the water jet to the right, as seen in FIG. 5. In FIG. 6 the tilting cylinder 22 has pulled the bearing housing 42 to the right-hand extreme position. Then the ball surface bearing 46 has turned the nozzle 20 so that it directs the water jet to the left, as seen in FIG. 6. In both cases the nozzle turns around the turning point formed by the bearing housing 50 and the ball surface bearing 48 at the opening 28 in the mounting plate 26. In a corresponding way the nozzle can be turned with the second tilting cylinder 24 in the cross-wise direction of the fabric.

The actual nozzle part of the nozzle, i.e. the lower part of the nozzle, can be removed from the nozzle by the joint 54, 56, as seen in FIG. 4, for instance for a replacement of the nozzle.

The invention is not intended to be limited to the above presented embodiment, but the intention is that it can be applied within the scope defined by the claims presented below.

What is claimed is:

1. A cleaning device for cleaning a fabric, the cleaning device comprising:

a nozzle for spraying a water jet against said fabric to be cleaned, water conduit means for supplying water to the nozzle, and means for changing the position of the nozzle so that the direction of the water jet from the nozzle is changed, the means for changing the position of the nozzle comprising first tilting means for turning the nozzle back and forth around a first turning point so that the water jet obtains a first linear motion, wherein the means for changing the position of the nozzle further comprise second tilting means for turning the nozzle back and forth around a second turning point so that the water jet obtains a second linear motion, substantially perpendicular to the first linear motion.

2. A cleaning device according to claim 1, wherein the second tilting means are arranged to turn back and forth so that they cause a perpendicular motion of the water jet from the nozzle relative to a travelling direction of the fabric, and wherein the first tilting means are arranged to turn back and forth so that they cause a linear motion of the water jet from the nozzle relative to the travelling direction of the fabric.

3. A cleaning device according to claim 1, wherein the first and/or second tilting means are tilting cylinders.

4. A cleaning device according to claim 1, wherein the nozzles are connected to the tilting means via ball surface bearings.

5. A cleaning device according to claim 1, wherein the first and second tilting means are fastened to the upper surface of a mounting plate arranged above the fabric to be cleaned, and wherein an opening is formed in the mounting plate at the location of the nozzle, to which opening the nozzle is connected via a ball surface bearing.

6. A cleaning device according to claim 1, wherein the cleaning device is fastened to a beam extending in a cross-direction of the fabric so that the device can move in the cross-direction of the fabric, and wherein the water conduit means are combined with water supply means arranged in the beam.

7. A cleaning device according to claim 1, wherein the cleaning device is combined with a drainage hood in order to remove the cleaning water.

8. A cleaning device according to claim 1, wherein:

the cleaning device is arranged above the fabric travelling over a roll, and fastened to a transversal beam arranged above the roll so that the device can be moved in a cross-direction, the nozzle of the cleaning device is arranged to spray water on the fabric passing over the roll, below the nozzle there is arranged a drainage hood in the cleaning device in order to remove the water sprayed on the fabric, and the lower part of the drainage hood is connected to a water discharge channel.

9. A cleaning device in a paper or board machine, for cleaning a fabric therein, the fabric moving in a direction of movement, said device comprising:

a nozzle which directs a water shower or jet against the fabric which is to be cleaned, the nozzle including a first turning point, and wherein there is a first plane of the water shower or jet issuing from the nozzle;

a plurality of water conduits which transport water to the nozzle; and the nozzle being mounted so that the position thereof may be changed by turning the nozzle back and forth around the first turning point in the first plane, so as to change the direction of the water shower or jet discharged from the nozzle and so that the water shower is moved in a first linear movement, wherein the nozzle includes a second turning point, and there is a second plane of the water shower or jet issuing therefrom; and wherein the nozzle is mounted so that the position thereof may be changed by turning the nozzle back and forth around the second turning point in the second plane, so as to move the nozzle in a direction perpendicular to the direction of movement of the fabric, and wherein the first linear movement of the nozzle moves the nozzle in the direction of movement of the fabric.

10. A device as recited in claim 9 wherein a plurality of substantially identical nozzles are provided, and wherein the nozzles are connected to bearings having spherical surfaces, and turned about the spherical surfaces during changing of the position thereof; and wherein the fabric comprises a wire or felt.

* * * * *